United States Patent [19]

Eckhardt

[11] 4,030,170

[45] June 21, 1977

[54] FELTING NEEDLE

[75] Inventor: Hellmuth Eckhardt, Herzogenrath, Germany

[73] Assignee: Torrington GmbH, Wurselen, Germany

[22] Filed: Apr. 15, 1976

[21] Appl. No.: 677,502

[30] Foreign Application Priority Data

Apr. 23, 1975 Germany ..... 2518066

[52] U.S. Cl. ..... 28/115

[51] Int. Cl.[2] ..... D04H 18/00

[58] Field of Search ..... 28/4 R, 4 N, 72.2 R, 28/115

[56] References Cited

UNITED STATES PATENTS

| | | | |
|---|---|---|---|
| 461,602 | 10/1891 | Boult | 28/4 N |
| 2,327,416 | 8/1943 | Foster | 28/4 N |
| 2,349,086 | 5/1944 | Foster | 28/4 N |
| 2,857,650 | 10/1958 | Lauterbach | 28/4 N |
| 3,307,238 | 3/1967 | Foster | 28/4 N |
| 3,624,675 | 11/1971 | Foster | 28/4 N |
| 3,641,636 | 2/1972 | Foster | 28/4 N |

*Primary Examiner*—Louis K. Rimrodt
*Attorney, Agent, or Firm*—Frank S. Troidl

[57] ABSTRACT

At least one barb is formed on the needle with a groove between the barb and the needle shaft. All of the surfaces of the barb and all of the surfaces of the groove are completely rounded in such a manner that no plane surfaces remain.

In some preferred modifications, the angle included by the forward line of the inside surface of the barb and the needle axis is 90° or more, and may range between 90°–100°.

The means for fixing the felting needle to a needle board may consist of a laterally deformed portion provided at the rear end of the needle shaft and extending transversely to the needle axis.

8 Claims, 22 Drawing Figures

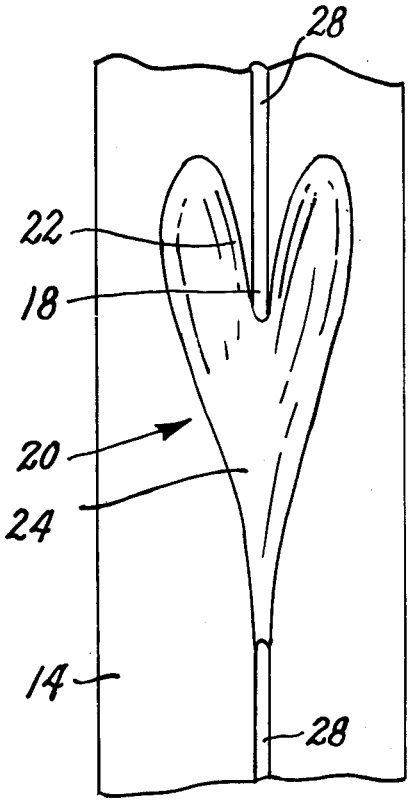
Fig. 3b
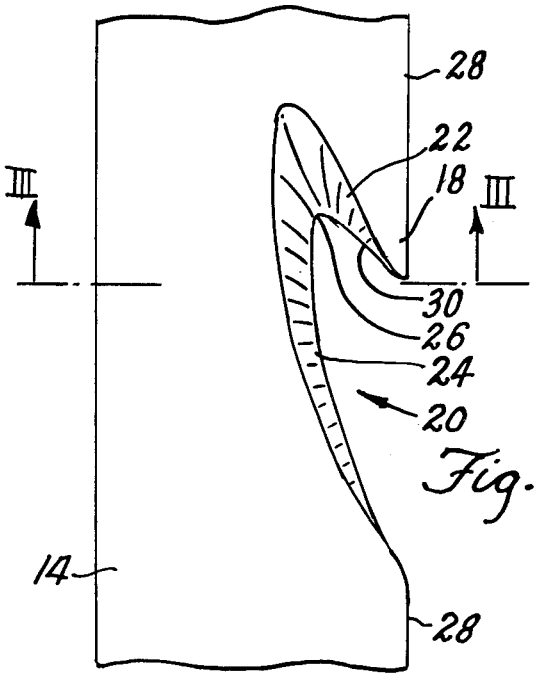
Fig. 3a
Fig. 3c
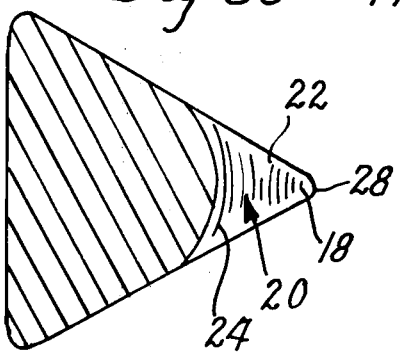
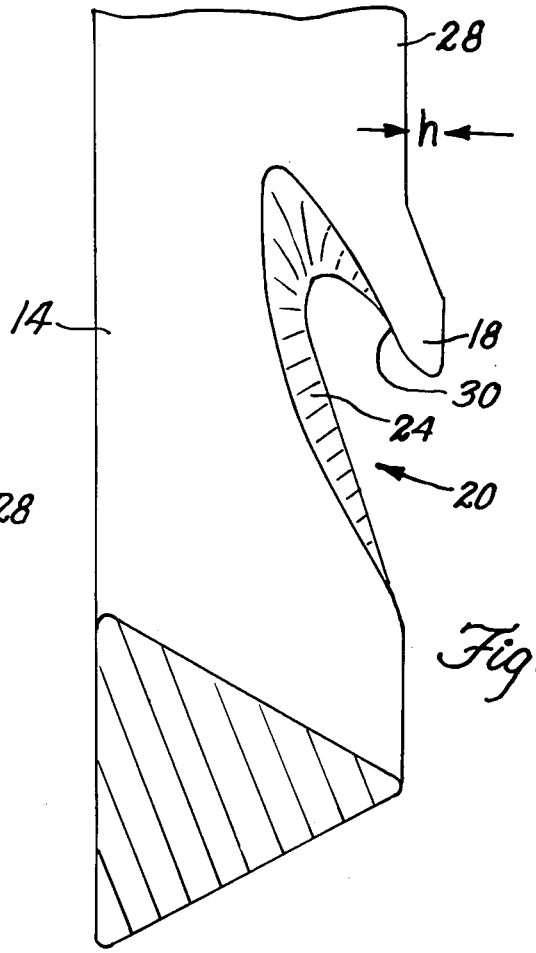
Fig. 4

Fig. 9b
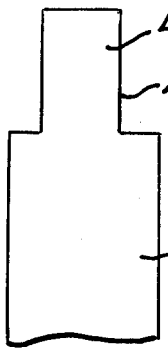
Fig. 9c
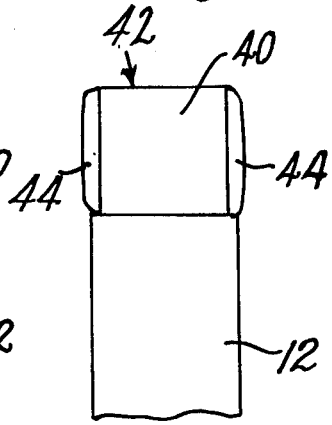
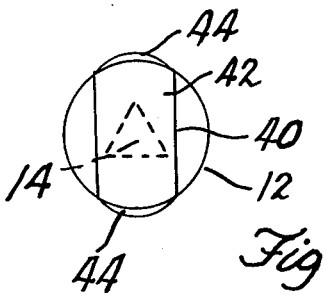
Fig. 9a
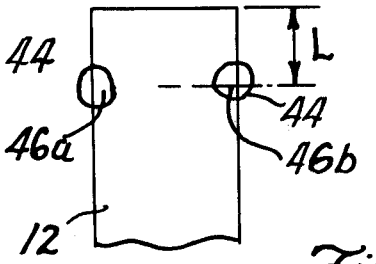
Fig. 10b
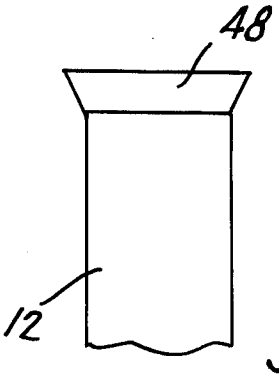
Fig. 11b
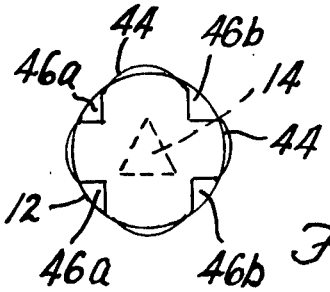
Fig. 10a
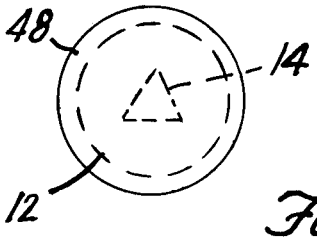
Fig. 11a

FELTING NEEDLE

This invention relates to felting needles. More particularly, this invention is a felting needle having novel grooves and barbs formed in the shaft of the felting needle. The new felting needle may also include a new structure for fixing the needle to a needle board.

Felting needles are repeatedly caused to penetrate into a loose non-woven fabric at right angles to the plane of the fabric so that the individual fibers of the fabric are interlaced and the fibrous material is compacted. This felting operation may also be used to needle the non-woven fabric to a backing, e.g., a woven fabric, when this is desired. The felting needles must be so designed that the damage to the individual fibers caused by the felting operation is minimized so that a long life of the resulting felt is ensured. Damage to the backing by the barbs of the felting needles during the needling operation should be avoided as much as possible. Also, the individual fibers should be compacted as effectively as possible and should be moved by the needles through the backing as far as possible. For these reasons, the felting needles must not break or cut the fibers and must have a fiber-entraining capacity which is as high as possible. Finally, the felting needles should have a minimum wear to ensure a long life.

The U.S. Pat. No. 3,307,238 issued Mar. 7, 1967 to Edson P. Foster, entitled "Felting Needle" shows a felting needle in which the inside surface of the barb has a rounded or convexly curved forward edge, which engages the fibers. Plane surfaces are disposed laterally of said forward edge and merge into the shaft of the needle at corners or sharp edges. The bottom surface of the groove is rounded or convexly curved on the side facing the barb but this surface also merges into the shaft of the needle at corners or sharp edges. There is a definitely acute-angled corner at the intersection between the inside surface of the barb and the bottom surface of the groove. When engaging the fibers, the sharp edges or corners of the needle act like knives and break or cut a large number of fibers. Owing to the above-described design of the barb and groove, which are shaped by a striking knife, a formation of substantial burrs must be expected at the transitions between the groove and barb, on the one hand, and the needle shaft, on the other hand. These burrs also tend to break or cut the fibers to be processed.

A similar felting needle is shown in U.S. Pat. No. 3,641,636, issued Feb. 15, 1972 to Edson P. Foster entitled "Felting Needle". In that needle, the inside surface of the barb is only slightly convexly curved and merges into the shaft of the needle at sharp lateral edges. In that needle, the bottom surface consists of three sections, the first of which is adjacent to the barb and is concavely curved in the longitudinal direction of the shaft and is convexly curved transversely thereto. The second section of the bottom surface consists of two plane surfaces which are symmetric with respect to the longitudinal axis of the groove and diverge toward the shaft of the needle. Straight-lined, sharp edges are formed at the intersection of these two plane surfaces and at the transition to the shaft of the needle. Even when these edges are obtuse-angled, they tend to cut the fibers to be processed. The third section of the bottom surface of the groove consists also of a surface which is convexly curved transversely to the axis of the needle and which also merges with the shaft of the needle at sharp edges. It is particularly significant that in that needle too a major part of the transition between the bottom surface of the groove and the inside surface of the barb consists of a sharp corner so that a breakage of fibers cannot be avoided.

In another known needle shown in U.s. Pat. No. 3,815,186 issued June 11, 1974 to Edson P. Foster, entitled "Felting Needle" the barb and groove have plane surfaces. In the middle of its end face, the barb has a relatively large plane surface which has a predetermined width and which is laterally adjoined by two outwardly diverging, plane surfaces. The edges formed between these surfaces are obtuse-angled. The bottom surface of the groove consists again of two sections. That section which faces the barb is formed by two plane surfaces which include an obtuse angle. The second section consists of a convexly curved surface. All surfaces merge into the shaft of the needle at an angle with formation of straight edges. Even when these straight edges are slightly rounded, this cannot prevent a fiber breakage at the usually high working speeds. With that needle too, just as with those described hereinbefore, burrs are formed during the formation of the groove and the barb by a striking knife and these burrs tend to destroy fibers.

Another known needle shown in U.S. Pat. No. 3,844,004, issued Oct. 29, 1974 to Edson P. Foster, entitled "Felting Needle" has basically the same design as those described hereinbefore. The barb has plane inside surfaces, which include an angle with each other, and has between said surfaces a rib, which faces the fibers to be processed. The bottom surface also has two plane surfaces which laterally diverge toward the shaft of the needle. The transitions are sharp-edged. It is particularly significant that there is a sharp corner in that needle between the inside surface of the barb and the bottom surface of the groove so that the needle tends to cut or break the fibers just as those described hereinbefore.

The U.S. Pat. No. 3,762,004, issued Oct. 2, 1973 to Richard W. Shepard, et al., entitled "Felting Needle" discloses a felting needle in which only the inside surface of the barb is convexly rounded, whereas the bottom surface of the groove is plane. This design has been selected to increase the strength of the needle and to reduce manufacturing and tool costs. Less consideration has been given to a high fiber-receiving capacity and to the desire to avoid damage to the backing with the aim of producing a considerably compacted felt which has been effectively needled. There are still edges at the transition between the inside surface of the barb and the shaft and particularly at the transition between the bottom surface and the shaft so that the needle does not meet all requirements concerning a felt of particularly high quality, even though the transition between the inside surface of the barb and the bottom surface of the groove is rounded.

To manufacture the known needles described hereinbefore, a forming knife is pushed into the edges of the shaft of the needle. In cross-section, the shaft of the needle is generally polygonal in cross-section and has in most cases the form of an equilateral triangle.

A basically different manufacture of needles is shown in U.S. Pat. No. 3,464,097, issued Sept. 2, 1969 to Josef Zocher entitled "Felting Needle". In accordance therewith, the groove, as well as the barb in the shaft of the needle, are formed by a die-pressing process, in which a die is used which completely encloses the shaft of the needle at the point to be shaped. By the use of that process, it is desired to form at least partly rounded surfaces and to avoid a formation of burrs. The barb has a convexly rounded inside edge, which is laterally adjoined by straight edges. The bottom surface of the groove is substantially plane. Narrow curved surface portions are provided only at the lateral transition to the shaft of the needle. In that case too, corners or edges are formed at the transition and can break or cut fibers. The transition between the inside surface of the barb and the bottom surface of the groove is formed by a rounded throat. Whereas this design of the needle allegedly reduces the destruction of fibers and increases the fiber-holding capacity, even that needle does not meet present-day requirements imposed by high-speed needling machines as regards a small tendency to destroy fibers, high compaction of fibers, good needling to a backing, and formation of a good felt surface. It has been found that this needle has a relatively low fiber-holding capacity and whereas this results in a long life of the needle, a relatively large number of needling operations are required for a satisfactory product. For this reason, this known needle is relatively expensive owing to the special method by which it is manufactured and is not sufficiently economical in operation in view of the requirements imposed by modern high-speed needling machines.

For this reason, it is an object of the invention to provide a felting needle with which all desires can be fulfilled at the same time because it satisfies the requirements that the fibers are not damaged (broken or cut) during the needling operation; the resulting felt has, as a result, a long life; the backing (woven fabric) is not damaged by the needling operation; the fibers are compacted as effectively as possible in a minimum number of operations; the fibers are effectively needled through the backing in a minimum number of operations; a felt of particularly high quality is produced (high surface finish, uniform and substantial needling through the backing); for the sake of an economical manufacture, this result is produced with a minimum of successive needling operations; the needle has a wear as low as possible, i.e., a long life; and the needle has low manufacturing costs.

The foregoing objects are accomplished by a felting needle in accordance with this invention which includes a barb inside surface, a groove bottom surface, a throat forming the transition between the barb inside surface and the groove bottom surface, all completely rounded in such a manner that no plane surfaces remain, and such surfaces merge into each other and into the needle shaft without sharp edges.

Because in accordance therewith all surfaces which contact the fibrous material are completely rounded so that plane surfaces and straight edges are avoided, the effective needle surfaces are so well rounded that contrary to all known needles, which still had sharp edges or plane surfaces somewhere, a destruction of fibers is virtually precluded. Owing to the complete rounding, the fibers can easily enter the needle and a large space for receiving and transporting fibers is available between the bottom surface of the groove and the inside surface of the barb as a result of the rounding, in comparison with known needles having the same size and the same length and the same kick-up or projection of the barb from the shaft of the needle. Nevertheless, the needle according to the invention can be made without a substantial formation of burrs, and only one knife blow per barb and groove will be required if the striking knife is properly designed. A formation of burrs by the action of the striking knife is avoided because the working faces of the knife and, in accordance therewith, the working faces of the needle which become effective during the needling operation, are well rounded and extend for a substantial distance along the shaft of the needle.

A felting needle which meets the above-mentioned requirements in a particularly effective manner will be obtained if, in accordance with a preferred feature of the invention, the curvatures of the inside surface of the barb, the bottom surface of the groove, and the throat are substantially convex in a sectional view on a plane which is transverse to the axis of the needle and are substantially concave in a sectional view on a plane which is parallel to the axis of the needle.

In known felting needles, the barb protrudes beyond the contour of the needle shaft transversely to the axis of the needle, in order to ensure a good engagement with the fibrous material and a high fiber-holding capacity. The extent to which the barb protrudes from the associated edge of the needle shaft is referred to as the "kick-up". It has been found in practice that such projecting barbs wear rapidly and contribute to the destruction of the fibers to be felted and of the backing.

These disadvantages are eliminated in accordance with another preferred embodiment of the invention in which the barb does not project beyond the edge of the needle shaft, so that the kick-up equals zero. If the barb has a suitable width, the tip of the barb may even be set back from the contour of the needle shaft, so that there is a negative kick-up. A good transport of the fibers is nevertheless enabled because in response to the penetration of the needle the loose fibers are forced laterally into the groove and are entrained in the needling direction by the inside surface of the barb. As a result, the life of the needles is considerably increased, particularly in modern high-speed needling machines.

The lateral projection of the barb beyond the contour of the needle shaft is due to the displacement of material caused by the blow of the shaping knife. At the outside edge of the needle shaft, the barb rises toward the pointed tip of the needle in the longitudinal direction of the needle. Due to this shape, the barb has a very small, sharp-edged cross-section, which tends to destroy fibers and wears rapidly.

According to another embodiment of the invention, these disadvantages can be eliminated in that the barb has an outside surface which is disposed at the outer edge of the needle shaft and which extends toward the pointed tip of the needle substantially at a small acute angle to the axis of the needle. As a result, there is also a negative kick-up although the barb may project beyond the contour of the needle shaft. In both cases which have been described, the negative kick-up and the barb can be obtained in one operation.

The angle of the negative kick-up from the axis of the needle may amount to 0°–20°, preferably 2°–10°. This results in a sufficient flattening of concave or convex rounding of the outer edge of the barb so that a destruction of fibers and wear of the barb will be avoided and the resulting barb has nevertheless a wide inside surface for an effective transport of fibers. In accordance with the invention, the lateral edges of the inwardly set back barb may be rounded so that a destruction of fibers in this region will be reliably avoided.

In previously known felting needles, the barb angle, specifically the angle between the forward line of the inside surface of the barb and the axis of the needle, always was an acute angle in the range of 45°–80° so that the barb easily penetrated the fibrous material to be felted and was rather aggressive in operation. In accordance with an additional embodiment, a larger barb angle of about 90° may be adopted. In specific cases, the barb angle may be even larger than 90° and may amount up to about 100°. The upper limit of the barb angle depends on the shape of the barb, the coefficient of friction of the metal employed, and the surface roughness and the coefficient of friction of the fibers to be processed. Even if the barb angle exceeds 90°, the self-locking properties of the co-acting materials (metal and fibers) will result in a transport of fibers although an increase of the barb angle will result in a decrease of the efficiency of the needling operation.

Such an increased barb angle according to the invention may be used with barbs and groove surfaces of any shape and design also with a zero or negative kick-up.

If desired, a needle shaft may be provided with at least two barbs which extend oppositely to each other with respect to the longitudinal axis of the needle. Such needle may be used to needle the fibrous material in mutually opposite directions so that special results can be produced, e.g, an improved needling to a backing in conjunction with a loosening of the material.

The previously known felting needles have a bend at their rear end, opposite to their pointed tip. This bend serves to fix the needles in a recess of a needle board against movement in the longitudinal direction of the needle and against rotation. Because such bend can be economically made, particularly when cold, only when its length exceeds a certain lower limit, adjacent needles in the needle board must be spaced apart by distances which are at least as large as the length of the bends. For this reason, known needles cannot be mounted with any desired small spacing.

To avoid this disadvantage, it is proposed to provide the needle shaft at its rear end with fixing means which instead of a bend, consist of a laterally deformed portion, which extends transversely to the axis of the needle. Such deformed portion, which departs from the originally cylindrical cross-section of the needle, can be used to fix the end of the needle shaft in the recesses of the conventional needle board and thus to hold the needle against longitudinal movement and rotation. The deformed portion may also indicate the rotational position of the needle. As a result, the needles may be more closely spaced in the needle board than before, so that the needling operation can be performed more uniformly and with higher efficiency. dr Illustrative embodiments of felting needles according to the invention will now be described with reference to the drawings in which:

FIGS. 3*a* 3*b*, and 3*c* show a second preferred embodiment of the felting needle with FIG. 3*a* being a side elevational view, FIG. 3*b* being a plan view and FIG. 3*c* being a sectional view taken along lines III—III of FIG. 3*a;*

Figure 5B:
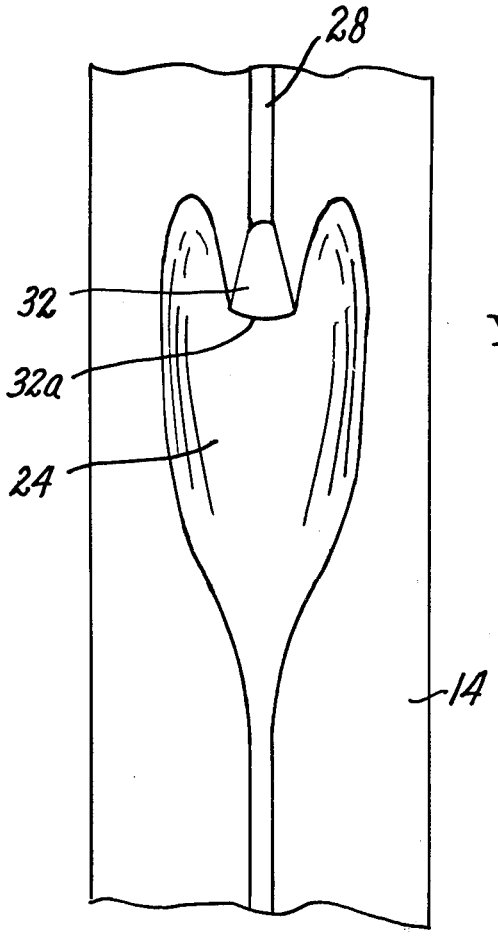
Figure 5A:
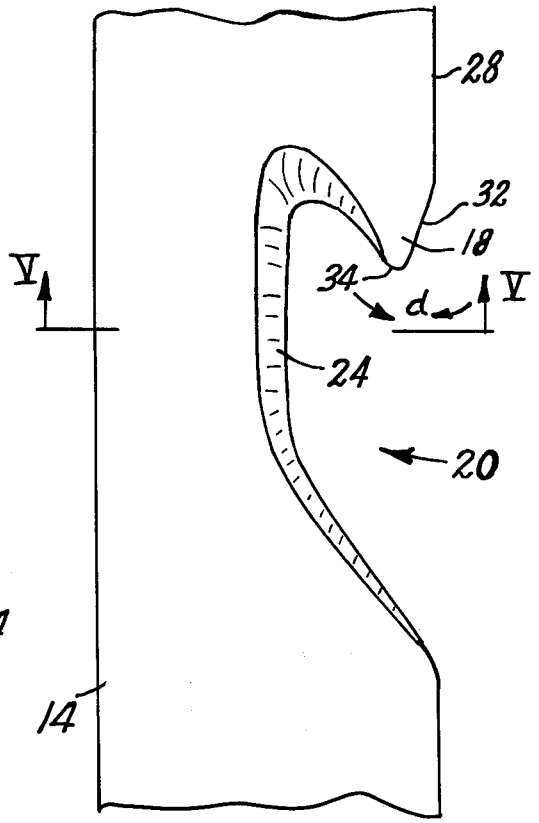
Figure 5C:
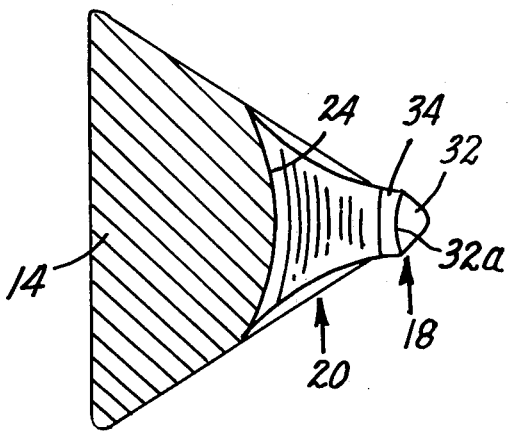

FIG. 4 is an elevation view of another preferred embodiment of the invention;

FIGS. 5*a*, 5*b* and 5*c* show another preferred embodiment of the invention with FIG. 5*a* being an elevational view, FIG. 5*b* being a plan view and FIG. 5*c* being a sectional view taken along lines V—V of FIg. 5*a;*

Figure 5D:
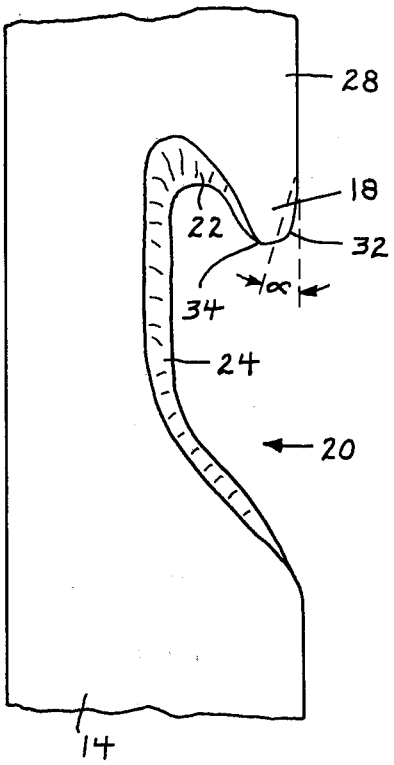

FIG. 5*d* shows a further preferred embodiment in an elevational view corresponding to FIG. 5*a;*

Figure 6C:
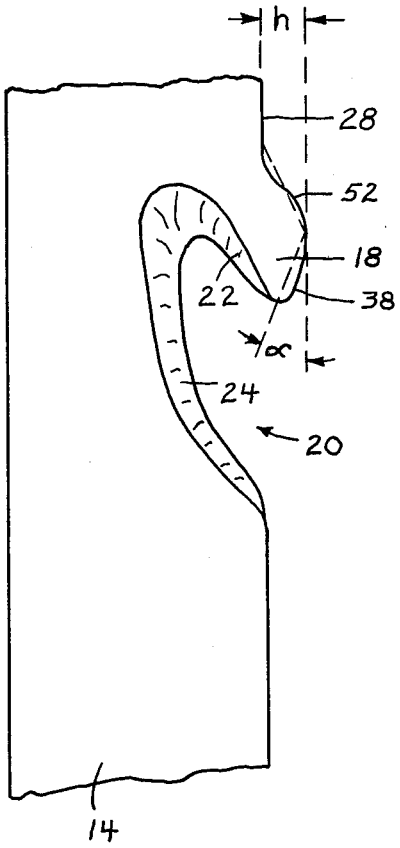
Figure 6A:
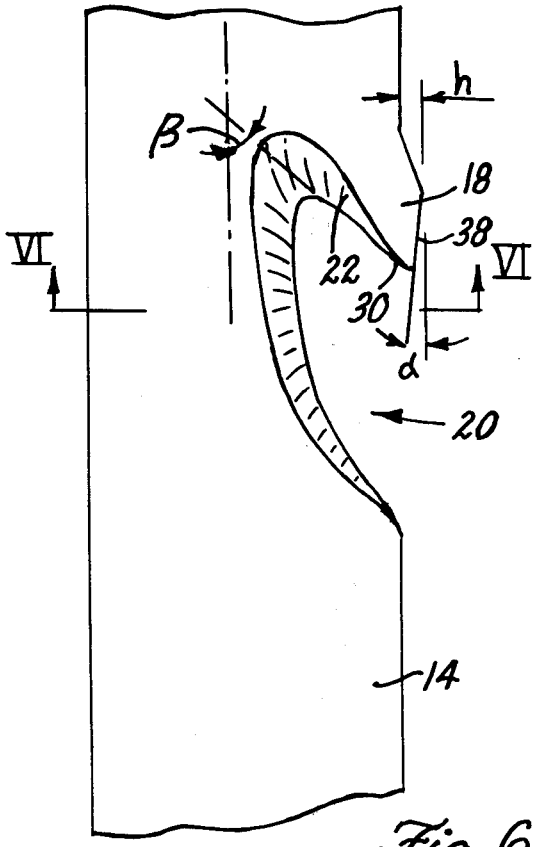
Figure 6B:
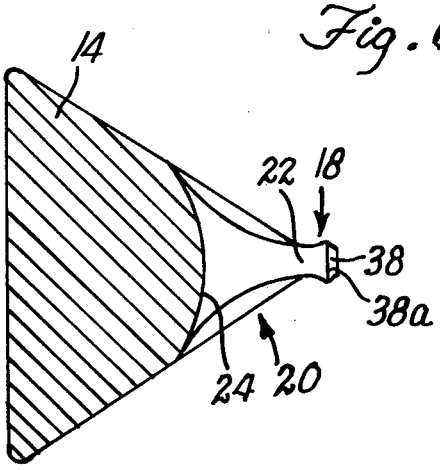

FIGS. 6*a* and 6*b* show still another preferred embodiment of a felting needle in accordance with the invention with FIG. 6*a* being an elevational view and FIG. 6*b* being a view taken along lines VI—VI of FIG. 6*a;*

FIG. 6*c* shows a further preferred embodiment in an elevational view corresponding to FIG. 6*a;*

Figure 7:
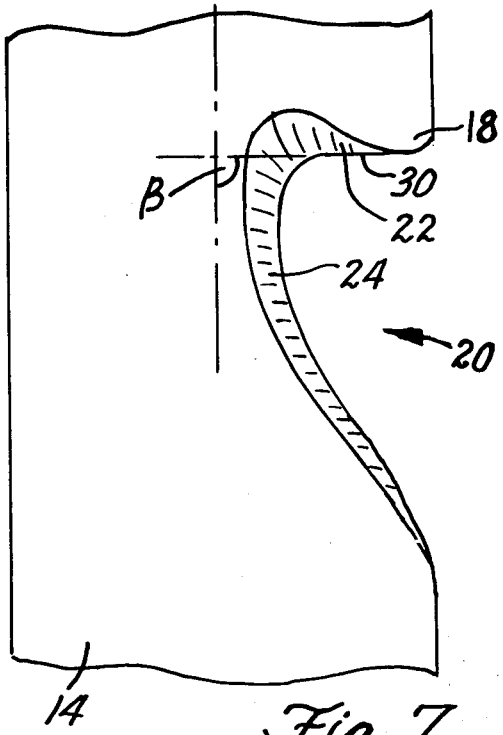
Figure 8:
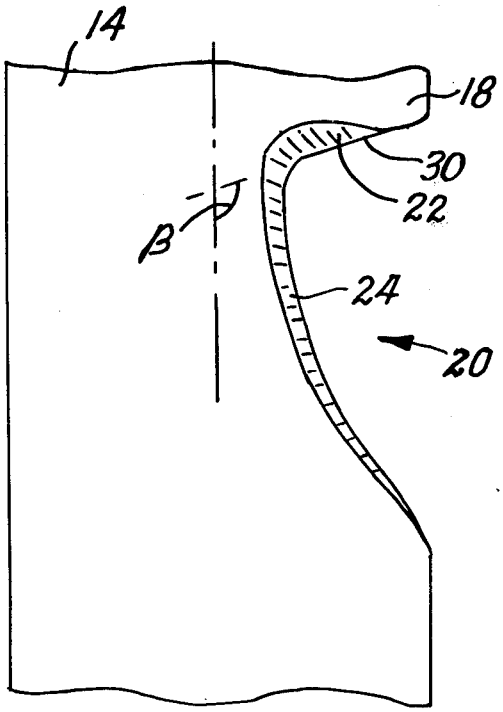

FIG. 7 is an elevational view of a needle in which the angle formed by the forward line of the inside surface of the barb and the needle axis is approximately a right angle;

FIG. 8 is an elevational view of a felting needle in which the angle formed by the forward line of the inside surface of the barb and the needle axis is an obtuse angle;

FIGS. 9*a*, 9*b*, and 9*c* show a preferred embodiment of a means at the free rear end of the needle shaft for fixing the needle in the needle board with FIG. 9*a* being a top view, FIG. 9*b* being an elevational view and FIG. 9*c* being a view taken from the right side of FIG. 9*b;*

FIGS. 10*a* and 10*b* show another preferred embodiment of the rear end of the needle shaft for fixing the needle in the needle board with FIG. 10*a* being a top view and FIG. 10*b* an elevational view; and FIGS. 11*a* and 11*b* show still another preferred embodiment of the rear end of the felting needle made in accordance with this invention for fixing the needle in a needle board with FIG. 11*a* being a top view and FIG. 11*b* being an elevational view.

Like parts in the various Figures are referred to by like numbers.

Figure 1:
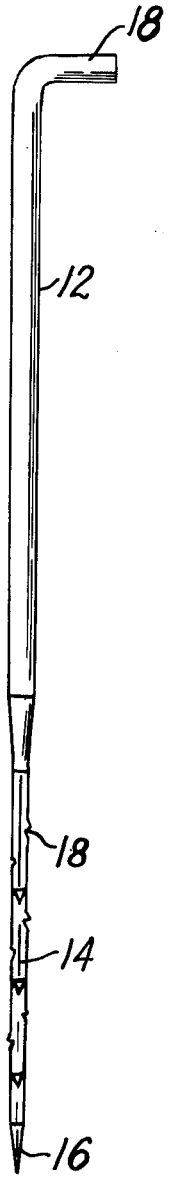
FIG. 1 is a side elevation showing a felting needle.

FIG. 1 is a side elevation showing a felting needle which comprises in known manner a cylindrical shaft 12 and an adjoining shaft section 14 which is polygonal in cross-section. In all embodiments shown by way of example, this cross-section has the configuration of an equilateral triangle. The shaft section 14 terminates in a pointed tip 16. At its rear end, the needle shaft 12 is provided with a bend 18, by which the needle can be fixed in a needle board.

At the edges of the shaft section 14, the felting needle carries a plurality of barbs 18, which are spaced apart along the needle. The barbs provided at different side edges are staggered in the longitudinal direction of the needle in known nanner, as is shown in FIG. 1. In dependence on the intended purpose, the felting needle according to the invention may be provided with only a single barb 18 at a single side edge, with one barb at each side edge, or with a plurality of barbs at one or each of a plurality of side edges, and the barbs may differ from each other or may be spaced different distances apart or may be mutually oppositely directed.

Figure 2:
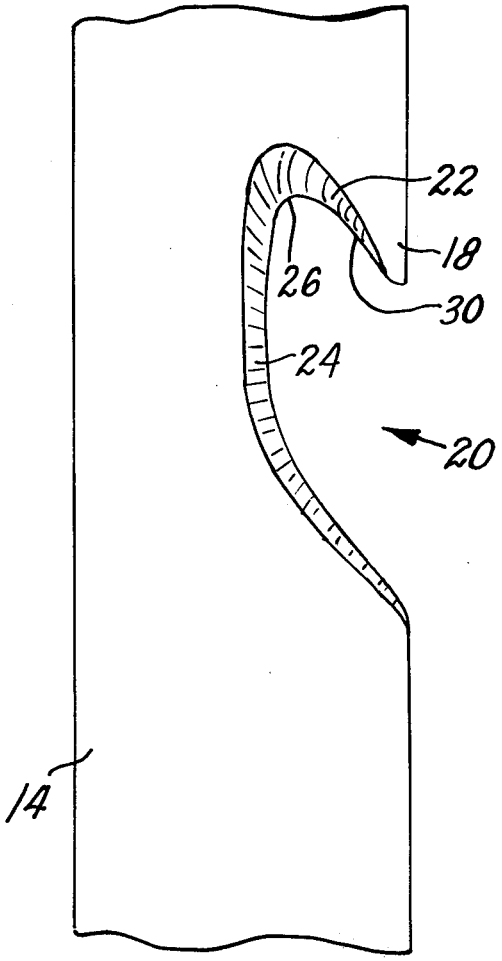
FIG. 2 is an enlarged side elevation showing a portion of a felting needle shaft provided wit a barb and a groove in accordance with one preferred embodiment of the invention.

FIG. 2 is an enlarged side elevation showing a portion of shaft section 14 provided with a barb 18 and a groove 20, which is formed in the associated side edge of the shaft section 14. The groove 20 has the basic shape shown in FIG. 2. The inside surface 22 of the barb 18 and the bottom surface 24 of the groove 20 are so rounded or curved that no plane surface portions are left in these surfaces. The inside surface 22 of the barb 18 and the bottom surface 24 of the groove 20 merge in a rounded throat 26. The surfaces 22 and 24 merge into the needle shaft 14 uniformly and gradually and without a sharp edge and gradually taper into the same. As is apparent from FIG. 2, the bottom surface 24 of the groove 20 and the inside surface 22 of the barb 18 have a substantially concave configuration when viewed transversely to the groove.

FIGS. 3*a*, 3*b*, and 3*c* show a second illustrative embodiment of a felting needle. The groove 20 has been struck into the needle shaft 14 to the same depth but is flatter. In that case the rounded or curved surface at the transition between the bottom surface 24 of the groove 20 and the inside surface 22 of the barb 18 may extend further back under the barb 18 in the longitudinal direction of the needle, even adjacent to the throat 26, than in the illustrative embodiment shown in FIG. 2.

As is apparent from FIGS. 3*a* to 3*c*, taken together, all surfaces adjacent to the barb 18 and the groove 20 are completely rounded or curved and merge into each other and the shaft of the needle without sharp edges. FIG. 3*c* shows that the side edge 28 of the shaft section 14 is truncated or rounded. The forward tip of the barb 18 is also rounded, as is apparent from FIGS. 3*a* and 3*b*. In a sectional view on a plane which is transverse to the longitudinal axis of the needle, as is apparent from FIG. 3*c*, the inside surface 22 of the barb 18 and the bottom surface 24 of the groove 20 are substantially convex. In a sectinal view on a plane which is parallel to the axis of the needle, viewed in a direction that is transverse to the groove, as shown in FIG. 3*a*, these surfaces are substantially concave. Because the shape of the surfaces of the groove and barb can be described only with difficulty, the disclosure of the drawing is incorporated by reference.

As is apparent from FIGS. 2 and 3*a*, the forward line 30 of the inside surface 22 of the barb 18 is also curved. This forward line may be substantially concavely curved. FIG. 4 shows an illustrative embodiment in which this forward line 30 is initially convexly curved in the portion that is adjacent to the tip of the barb 18 and is substantially concavely curved in the portion which faces the bottom 24 of the groove.

FIG. 4 shows also that the shaft section 14 has in cross-section the configuration of an equilateral triangle having truncated or rounded corners.

As is apparent from FIGS. 2 through 4, particularly FIGS. 3*a* through 3*c*, a descent of the needles into fibers to be felted has the result that these fibers gently contact the rounded or curved surfaces of the groove and barb on all sides. It is even possible to say that the fibers hug these surfaces. Because there are no plane surfaces, no straight edges and not even sharp transitions between the individual surfaces, and there is no sharp-edged transition to the shaft section 14, the risk of a fiber breakage or a cutting of the fibers has been completely eliminated.

As is apparent from FIG. 4, the barb projects laterally from the needle shaft 14 beyond the side edge 28 by the distance *h*. This extent of projection will also be referred to as kick-up hereinafter. Such kick-up is known with felting needles and has the result that the tip of the barb 18 is disposed outside the needle shaft 14 so that the descending barb 18 can engage the fibers to be felted and can force them into the groove 20. It has been found that such lateral projection of the barb 18 will not be required if the curved surfaces of the barb 18 and the groove 20 are properly designed. FIGS. 2 and 3*a* through 3*c* show barbs 18 which do not laterally project beyond the edge 28 of the needle shaft 14. In this case, the outside edge of the barb is aligned with the side edge 28. Nevertheless, such barb 18 when descending is sufficiently active or aggressive to force the fibers to be felted into the groove 20. This is due to the fact that the curvature or rounding of the bottom surface 24 causes the fibers to be pulled laterally into the groove 20 during a descent of the needle shaft 14.

FIGS. 5*a* through 5*c* show another embodiment, in which the outer edge and the tip of the barb 18 do not protrude beyond the side edge 28 but are even set back inwardly from said side edge. This is referred to as a negative kick-up.

FIG. 5*c* is a sectional view taken on line V—V in FIG. 5*a*. It is apparent from FIGS. 5*b* and 5*c* that the negative kick-up results in the formation of a substantially triangular to trapezoidal surface 32 on the outside of the barb 18. Below that surface there is a surface 34 which extends substantially transversely to the axis of the needle. The boundary line 32*a* may alternatively be convexly or concavely curved. In this case, the barb 18 has no sharp tip. All corners and edges of the surfaces 32 and 34 of the barb 18 are preferably rounded.

During the descent of the needle shown in FIGS. 5*a* through 5*c*, the fibers are also effectively engaged in a sufficiently large quantity and are pulled into the incised groove 20, which is perfectly curved or rounded so that damage to the fibers is avoided in spite of the high fiber-holding capacity. The embodiments shown having a zero kick-up, shown in FIGS. 2 and 3*a* through 3*c*, and the embodiment having a negative kick-up, shown in FIGS. 5*a* through 5*c*, product the additional result that the wear of the tip of the barb 18 is extremely low so that the needle has a long, useful life.

Because the tip of the barb 18 is rounded and the kick-up is zero or negative, the fibers being felted and the backing to which the fibers are needled will be preserved during the penetration of the needles so that a very good felting and needling through the backing will be obtained and a large portion of the fibers will be pulled through the backing.

FIG. 5*d* shows in a view corresponding to FIG. 5*a* a further embodiment in which also the outside surface 32 of the barb 18 extends substantially at a small acute angle $\alpha$ toward the pointed tip 16 of the needle. However, in this embodiment the outside surface 32 of the barb 18 is rounded and curved in such a manner (as shown schematically in FIG. 5*d*) that it merges without sharp edges into the needle shaft 14 and into its outer edge 28 as well as into the inside surface 22 of the barb 18 and gradually tapers into these portions (shaft 14, edge 28, surface 22).

FIG. 6*a* shows another embodiment of a felting needle. FIG. 6*b* is a sectional view taken on line VI—VI in FIG. 6*a*. In this needle the barb has a positive kick-up *h*. As in the embodiment shown in FIG. 4, this positive kick-up is produced in that material of the needle shaft is laterally displaced during the shaping of the groove 20 and the barb 18 by a striking knife. This material results in the kick-up, which may be formed back in part or entirely or even behind the side edge 28. A positive kick-up as shown in FIG. 4 may be formed in this way or a zero kick-up (FIGS. 2 and 3*a*) or even a negative kick-up (FIGS. 5*a* and 6*a*). The surface 32 in FIGS. 5*a* through 5*c* and 38 in FIGS. 6*a* and 6*b* which are thus obtained on the outside of the barb 18 then extend at a small acute angle $\alpha$ toward the pointed tip 16 of the needle (FIG. 1). The angle $\alpha$ may amount to 0°–20°, preferably 2°–10°. During the formation of the negative kick-up at the angle $\alpha$ in the embodiment shown in FIGS. 5*a* through 5*c*, a blunt rounded surface 34 is formed on the front of the barb 18. In the embodiment shown in FIGS. 6*a* and 6*b*, this surface may be omitted so that the inclined outside surface 38 merges directly into the inside surface 22 of the barb 18 with a rounded transition and the boundary line 38*a* may be convexly or concavely curved.

FIG. 6*c* shows in a view corresponding to FIG. 6*a* a still further embodiment in which also the outside surface 38 of the barb 18 extends substantially at a small acute angle $\alpha$ toward the pointed tip 16 of the needle. In this embodiment, however, also the outside surface 38 of the barb 18 is rounded and curved in such a manner (as schematically shown in FIG. 6*c*) that also the outside surface 38 merges without sharp edges into the needle shaft 14 and into the inside surface 22 of the barb 18 and gradually tapers into these portions (shaft 14, surface 22).

Due to the barb 18 laterally projecting beyond the needle shaft 14 and its outer edge 28, respectively, by the distance *h*, there is formed a rear surface 52 of the barb 18 behind the outside surface 38 in the direction toward the rear needle end, which rear surface 52 is adjacent to or contiguous to the outside surface 38. According to FIG. 6*a* this rear surface 52 extends straightly at a small acute angle with regard to the needle axis, so that according to the embodiment of FIG. 6*a* in the area of the rear surface 52 sharp edges or corners are present at the merging zones of the rear surface 52 with the needle shaft 14. According to the embodiment of FIG. 6*c* the rear surface 52 is now also rounded and curved in such a manner that it merges without sharp edges into the needle shaft 14 and into its outer edge 28 and gradually tapers into these portions.

FIGS. 5*d* and 6*c* can only schematically illustrate the principle of rounding or curving the outside and rear surfaces 32, 38, 52 of the barb 18, since within the scope of the invention a plurality of different possibilities exists, which possibilities can only poorly be described or shown in the drawings.

In the previously described felting needles, the barb 18 and specifically the forward line 30 of the inside surface 22 of the barb 18 extends toward the pointed tip 16 of the needle (FIG. 1) at an acute angle to the needle axis. In conventional needles, this angle is substantially in the range of 45°–80°. This angle is designated $\beta$ in FIG. 6*a*,.

FIG. 7 shows a needle in which this angle $\beta$ is about 90°, i.e., the angle included by the forward line 30 of the barb 18 and the needle axis is approximately a right angle. In the embodiment shown in FIG. 8, there is even an obtuse angle $\beta$. In this case the angle included by the forward line 30 of the barb 18 and the needle axis may lie in the range of 90°–100°, In other respects, the felting needles shown in FIGS. 7 and 8 are substantially identical to the needles described hereinbefore. Specifically, all surfaces of the groove 20, particularly the groove bottom 24, and all surfaces of the barb 18, particularly its forward face 22, which contains the forward line 30, are curved or rounded. Sharp-edged transitions or plane surfaces are avoided.

Each barb 18 and the associated groove 20 of each felting needle which has been shown can be made by a single blow with a suitably shaped striking knife. The striking knife has such a shape that it produces the several surfaces in the desired shapes and also ensures a gentle and uniform transition between these surfaces and the shaft 14 of the needle whereas a formation of burrs is avoided.

A felting needle has generally only barbs and grooves of a certain, uniform shape. For special uses or where specific products are desired, barbs and grooves having different shapes may be provided along the shaft of the needle. For instance, a needle may be provided with so-called working barbs having a relatively large positive kick-up and so-called equalizing barbs having a negative kick-up or zero kick-up.

FIGs. 9*a* through 11*b* show different designs of the needle shaft 12 at its rear end remote from the pointed tip of the needle. As has been stated in conjunction with FIG. 1, the needle shaft 12 is cylindrical. Whereas the bend 18 is provided at the rear end in accordance with FIG. 1, FIGS. 9*a* through 11*b* show various other means for fixing the needle in a needle board.

In accordance with FIGS. 9*a* through 9*c*, the free rear end of the needle shaft 12 is laterally flattened by pressing or striking operations performed on two diagonally opposite portions so that lateral notches 40 result as well as a land portion 42 between said notches. As a result of the displacement of the material, this land portion is radially outwardly enlarged beyond the originally cylindrical contour of the needle shaft 12 transversely to the direction in which the shaft has been flat-pressed. This out-of round end portion 42 can be used to fix the needle in the needle board.

FIGS. 10*a* and 10*b* show fixing means which have been formed in that notches 46*a* and 46*b* have been impressed in pairs on two mutually opposite sides of the needle shaft 12 transversely to the longitudinal axis thereof. The notches 46*a* are aligned with each other and the notches 46*b* are also aligned with each other so that the shape shown in FIG. 10*b* is obtained in side elevation. It is apparent that radially enlarged portions 44 have been formed because material of the needle shaft 12 has been displaced from the notches 46*a*, 46*b*.

The distance L from the notches 46*a*, 46*b* to the rear free end of the shaft 12 can be exactly controlled during the manufacture so that in this embodiment the needle shafts 12 can also be satisfactorily anchored in the needle board.

When a laterally deformed portion (such as 40 in FIGS. 9*a* through 9*c* or 46*a* or 46*b* in FIGS. 10*a* and 10*b*) is provided only at one point of the cylindrical periphery of the needle shaft and this single deformed portion has in all needles of a series the same orientation in the peripheral direction relative to the barbs 18 of the needle, this deformed portion may be used during the insertion of the needles into the needle board to determine the rotational position of the needles with respect to the needle axis in such a manner that, e.g., all needles of a needle board have the same orientation.

Finally, FIGS. 11*a* and 11*b* show different fixing means provided at the rear end of the needle shaft 12. In this case the rear end is upset in the axial direction of the needle so that an enlarged head 48 is formed, which also prevents a slipping of the needle shaft 12 through the holes in the needle board and which locks itself in the, e.g., prismatic apertures on the rear of the needle board.

I claim:

1. A felting needle comprising: a needle shaft with at least one barb formed on the shaft and a groove between the barb and the shaft, the groove being defined by a bottom surface, the inside surface of the barb, and a throat serving as a transition between the bottom surface and the inside surface of the barb, the bottom surface, inside surface of the barb, and the throat all being completely rounded in such a manner that no plane surfaces remain, and that said surfaces merge into each other and into the needle shaft without sharp edges.

2. A felting needle according to claim 1, wherein the curvatures of the bottom surface, inside surface of the barb and the throat are substantially convex in a sectional view on a plane which is transverse to the axis of the needle and are substantially concave in a sectional view on a plane which is parallel to the axis of the needle.

3. A felting needle according to claim 1 wherein the forward line of the inside surface of the barb is curved.

4. A felting needle according to claim 3, wherein the forward line is substantially concavely curved.

5. A felting needle according to claim 3, wherein the forward line is convexly curved adjacent to the tip of the barb and concavely curved in the portion facing the groove bottom.

6. A felting needle comprising: a needle shaft with at least one barb formed on the shaft and a groove between the barb and the shaft, the groove being defined by a bottom surface, the inside surface of the barb, and a throat serving as a transition between the bottom surface and the inside surface of the barb, the bottom surface, inside surface of the barb, and the throat all being completely rounded in such a manner that no plane surfaces remain, said surfaces merging into each other and into the needle shaft without sharp edges; and a laterally deformed portion at the rear end of the needle shaft extending transversely to the needle axis for fixing the needle to a needle board.

7. A felting needle according to claim 6 wherein the outside surface of the barb is rounded and curved in such a manner that it merges without sharp edges into the needle shaft and into the outer edge thereof as well as into the inside surface of the barb and gradually tapers into these portions.

8. A felting needle according to claim 7, with a barb laterally projecting beyond the needle shaft, wherein also the rear surface of the barb, adjacent to the outside surface of the barb in the direction toward the rear needle end, is rounded and curved in such a manner that it merges without sharp edges into the needle shaft and into its outer edge and gradually tapers into these portions.

* * * * *